United States Patent [19]

Dodge

[11] 4,305,588

[45] Dec. 15, 1981

[54] ARCHERY ARROW NOCK

[76] Inventor: Paul A. Dodge, Rte. 3, Menomonie, Wis. 54751

[21] Appl. No.: 137,020

[22] Filed: Apr. 4, 1980

Related U.S. Application Data

[63] Continuation-in-part of Ser. No. 33,724, Apr. 26, 1979, abandoned.

[51] Int. Cl.[3] ..... F41B 5/02

[52] U.S. Cl. ..... 273/416; 403/268

[58] Field of Search ..... 273/416–423; 403/268, 267, 265, 334, 292

[56] References Cited

U.S. PATENT DOCUMENTS

| | | | |
|---|---|---|---|
| 752,669 | 2/1904 | Guzowski | 403/268 |
| 1,394,137 | 10/1921 | Blair | 403/268 |
| 1,423,551 | 7/1922 | Adriance | 273/419 |
| 2,199,532 | 5/1940 | Weeks | 403/268 X |
| 2,245,187 | 6/1941 | Donash . | |
| 2,581,884 | 1/1952 | Ringel . | |
| 2,816,765 | 12/1957 | Stockfleth | 273/421 |
| 3,034,789 | 5/1962 | Moore . | |
| 3,214,174 | 10/1965 | Saunders . | |

FOREIGN PATENT DOCUMENTS

| | | |
|---|---|---|
| 2632288 | 1/1978 | Fed. Rep. of Germany . |
| 1470802 | 4/1977 | United Kingdom . |

*Primary Examiner*—Paul E. Shapiro

*Attorney, Agent, or Firm*—Burd, Bartz & Gutenkauf

[57] ABSTRACT

An arrow nock which includes a base secured to the rearward end of an arrow shaft. First and second legs extending from the base are transversely spaced apart to define a bowstring notch. First and second curved beads are centrally located on the interior surfaces of the legs which define the notch and have outwardly projected crests which form a throat to impede movement of the bowstring from the seat of the notch when the arrow is not drawn back, but permit relatively free flight of the arrow when the bowstring is drawn back and released. The nock has a forwardly open cavity for assembly to the end of an arrow shaft. The cavity can have retaining ribs located therein for retention of glue to secure the nock to the arrow shaft.

38 Claims, 12 Drawing Figures

FIG. 1
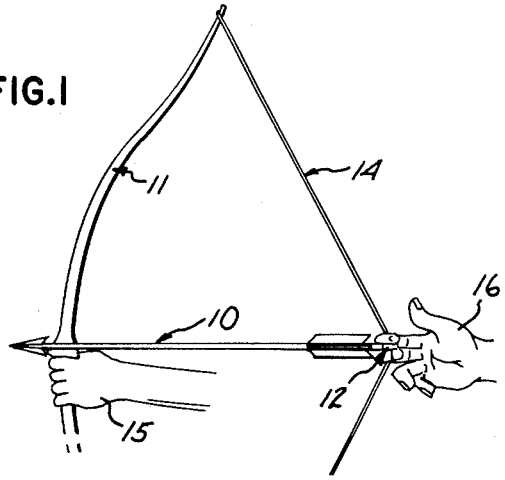
FIG. 3
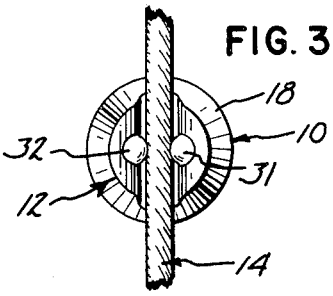
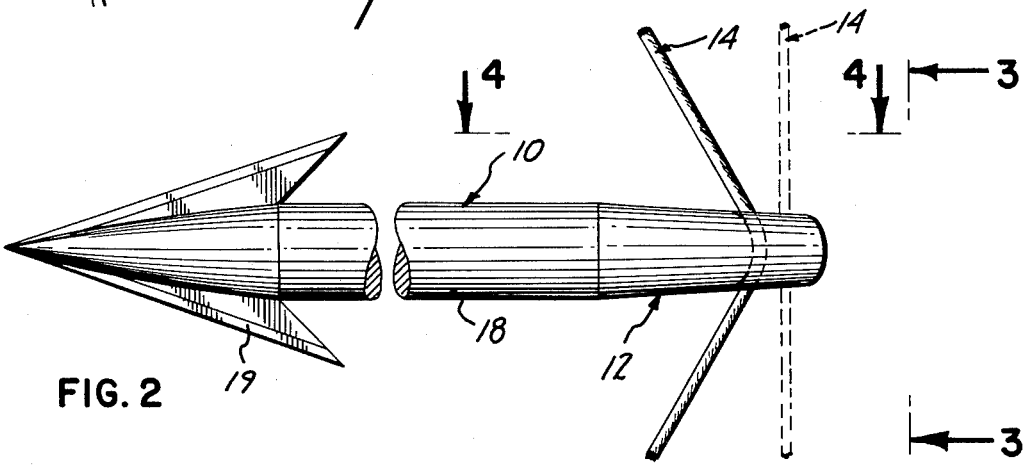
FIG. 2
FIG. 4
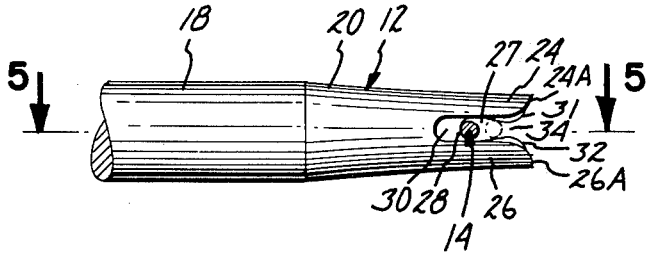
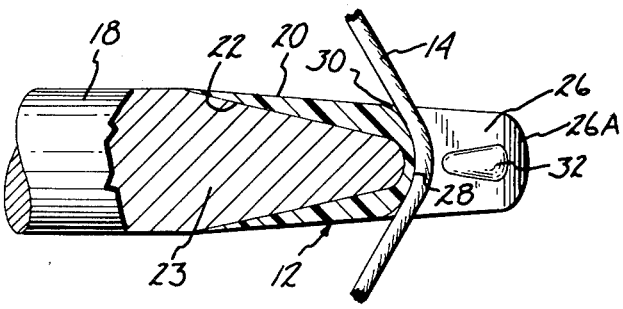
FIG. 5

FIG. 6
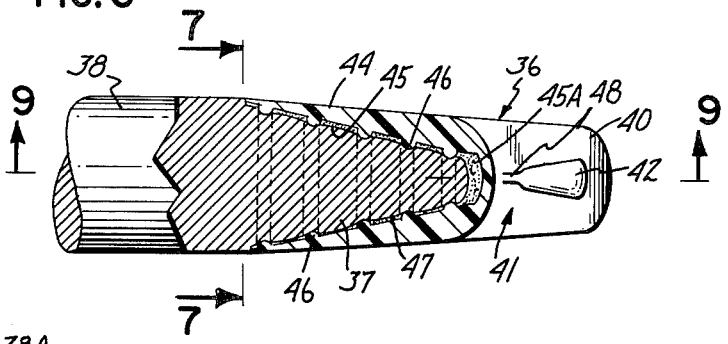
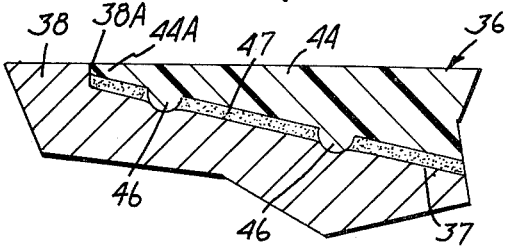
FIG. 8
FIG. 7
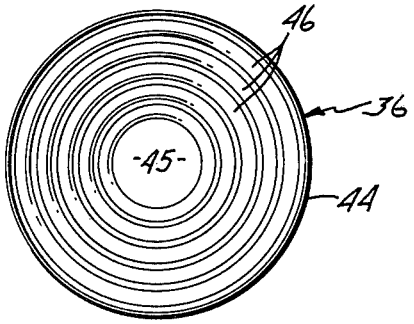
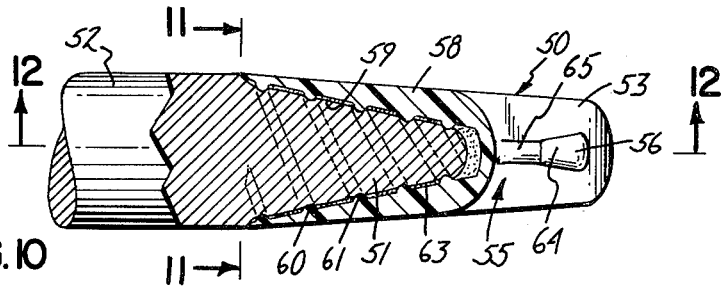
FIG. 10
FIG. 9
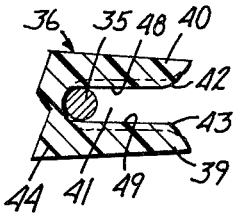
FIG. 12
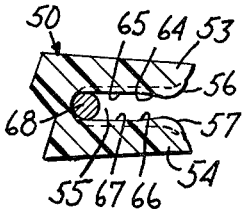
FIG. 11
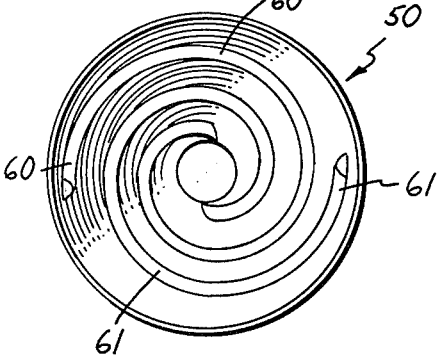

ARCHERY ARROW NOCK

CROSS REFERENCE TO RELATED APPLICATION

This application is a continuation-in-part of U.S. application Ser. No. 33,724 filed Apr. 26, 1979 entitled Archery Arrow Nock, now abandoned.

SUMMARY OF THE INVENTION

The invention relates to an archery arrow nock configured to impede accidental slippage from a bowstring. Conventional arrow nocks include a rearwardly outwardly tapered notch for receipt of the bowstring during drawback and release of the arrow. The notch is defined by a pair of spaced apart legs usually having the greatest dimension between them at the rearward end of the nock to facilitate receipt of the bowstring. The narrowest transverse dimension of the notch or the narrowest spacing between the legs occurs at the conjunction of the legs or the inner end of the notch where the bowstring is seated during drawback procedure. The arrow nock is sometimes prone to slip on the bowstring during the drawback procedure. As the bowstring is not rearwardly confined in the notch of the nock, when the drawback is let down gradually, as frequently occurs when the archer decides momentarily not to release the arrow, the nock is prone to slip off of the bowstring. This can be annoying and distracting. In the prior art there are arrow nocks which have a throat between the seat of the notch and the mouth of the notch to impede this slippage. However, such a throat usually provides objectionable frictional drag upon release of the arrow.

According to the present invention there is provided an arrow nock with spaced apart legs defining a tapered notch for receipt of a bowstring segment. The inner end of the notch provides a seat for the bowstring during drawback of the bow. A throat is provided in the notch to impede accidental disengagement of the bowstring from the nock. The throat is defined by a pair of spaced apart beads located on interior surfaces of the legs and spaced apart a distance less than the transverse distance of the notch seat. The width of the beads is less than the width of the legs of the nock. The beads are teardrop-shaped being gradually tapered toward the notch seat to provide minimal resistance for passage of the bowstring upon release of the arrow, but to impede accidental disengagement of the arrow when the bowstring is not drawn back. The nocks can have forwardly open bores or cavities for assembly to the end of an arrow shaft. The cavities have retaining ribs located therein for retention of glue and to secure the nock to the shaft.

IN THE DRAWINGS

FIG. 1 is a side elevational view of an arrow in drawn relationship relative to a bow and equipped with an arrow nock according to one form of the present invention;

FIG. 2 is an enlarged view of the arrow shown in FIG. 2 foreshortened for purposes of illustration;

FIG. 3 is an end view of the arrow of FIG. 2 taken along the line 3—3 thereof;

FIG. 4 is a top elevational view of a portion of the arrow of FIG. 2 taken along the line 4—4 thereof;

FIG. 5 is an enlarged sectional view of the arrow segment of FIG. 4 taken along the line 5—5 thereof;

FIG. 6 is a view partly in section similar to FIG. 5 showing a second form of the arrow nock of the present invention;

FIG. 7 is an enlarged sectional view of the nock in FIG. 6 taken along the line 7—7 thereof with the arrow shaft removed;

FIG. 8 is an enlarged view of a portion of the arrow nock shown in FIG. 6;

FIG. 9 is an enlarged sectional view of the arrow nock of FIG. 6 taken along the line 9—9 thereof and showing both legs of the arrow nock;

FIG. 10 is a view partly in section similar to FIG. 5 showing a further form of arrow nock of the invention;

FIG. 11 is an enlarged sectional view of the nock of FIG. 8 taken along the line 10—10 thereof with the arrow shaft removed; and FIG. 12 is an enlarged sectional view of the arrow nock of FIG. 10 taken along the line 12—12 thereof and showing both legs of the arrow nock.

DESCRIPTION OF PREFERRED EMBODIMENTS

Referring to the drawings there is shown in FIG. 1 an arrow 10 set and drawn in a bow 11, the nock 12 of the arrow engaging a segment of the bowstring 14 in the conventional manner. The left hand 15 of the archer is forwardly extended and seizes the forward portion or grip of the bow 11. The fingers of the right hand engage the bowstring in straddling relationship to the nock 12. Alternatively, the archer could employ any of the various bowstring release devices available to draw back the bowstring 14. Bowstring 14 is drawn preparatory to release of the arrow 10.

As shown in FIG. 2, arrow 10 includes an elongate shaft 18 with an arrowhead 19 at the forward end thereof. Nock 12 is installed on the rearward end of shaft 18. Nock 12 has a forward base 20 with a tapered sleeve-like opening or cone shaped recess 22. Arrow shaft 18 has a tapered rearward end 23 installed in the opening 22 and secured therein by conventional means such as gluing. The end of base 20 has a diameter corresponding to the diameter of shaft 18 and the outer surfaces of base 20 taper slightly inward therefrom to avoid interference of nock 12 with the bow 11 upon release of the arrow.

Arrow nock 12 includes first and second parallel transversely spaced apart legs 24, 26 defining a bowstring notch 27 terminating in an inward U-shaped notch seat 28 at the conjunction of legs 24, 26 to accommodate a bowstring segment being drawn back. The transverse dimension of the notch 27 corresponds to the diameter of the bowstring 14 such that the bowstring 14 is snuggle accommodated in seat 28, and the width of notch 27 corresponds to the width of the legs 24, 26 as shown in FIG. 5. A groove 30 is formed in base 20 as a continuation of seat 28 to accommodate the curvature of the segment of bowstring 14 engaged by nock 12. First and second raised projections or beads 31, 32 are formed on the interior surfaces of first and second legs 24, 26 respectively in spaced apart facing relationship to one another. Beads 31, 32 form a throat of a transverse dimension less than that of notch 27 proximate seat 28 to restrict passes of bowstring 14.

As shown in FIGS. 4 and 5, each bead 31, 32 is generally pear or teardrop-shaped with an elongate gradually sloping ramp surface orientated toward seat 28 of notch 27. The width of each bead is less than the width of the respective leg upon which it is situated and each bead has a rounded crest projected into notch 27 to form throat 34. The outer end of each bead has an arcuate convex outer surface located inwardly from the outer ends of the legs 24 and 26. The inner end of each bead has an arcuate convex outer surface that is smaller than arcuate outer surface of the outer end thereof. Consequently, throat 34 is relatively narrow in width as compared to the width of the legs. The convex curvature of the beads provides a smooth transition from seat 28 to and through throat 34. The transverse dimension of throat 34 is slightly less than the diameter of bowstring 14. Legs 24, 26 are slightly resilient, as by being molded of plastic or the like, and will yield against the force of inertia of an arrow being thrust by a drawn bowstring to permit passage of the bowstring 14 past the crests of beads 31, 32 and through the throat 34 from seat 28. When bowstring 14 is not drawn, as shown in phantom in FIGS. 2 and 4, and when no forward force is applied to the arrow 10, bowstring 14 rests in engagement with the beads 31, 32 at the inward entrance of throat 34. The arrow does not inadvertantly fall off of the bow being held by the slight force provided by beads 31, 32 at throat 34.

Referring to FIGS. 6 through 9, there is shown an arrow nock 36 according to a modification of the invention installed on the conical or tapered rearward tip 37 of an arrow shaft 38. Arrow nock 36 has a pair of transversely spaced apart legs 39, 40 defining a bowstring retaining notch 41. Leg 40 has a bead 42 for coacting with a second bead 43 on opposing leg 39 as previously described relative to the nock of FIGS. 1 through 5 in order to retain the nock with respect to the bowstring.

Nock 36 has a base 44 with a thin walled forward portion defining a rearwardly tapered or conical opening or cavity 45 generally configured so that tip 37 of arrow shaft 38 fits snugly therein. A plurality of concentric circular retaining ridges or ribs 46 are formed on the inside walls of base 44 defining cavity 45. Ribs 46 are uniformally spaced apart rings and project inwardly into cavity 45 so to be in surface contact with the surface of the tip 37 of arrow shaft 38. Nock 36 is installed on tip 37 with exertion of a small amount of force. Ribs 46 cause localized deformation of tip 37 of arrow shaft 38 to secure the nock 36 in place. A binder or glue 47 can fill the space between the tip 37 of shaft 38 and the interior walls of base 44 between the ribs 46 to securely fasten arrow nock 36 to arrow shaft 38. Ribs 46 can project inwardly, for example, a distance of 0.004 inches to 0.008 inches (0.1 mm to 0.2 mm). The glue 47 between ribs 46 serves the usual function of adhering the surface of tip 37 to the interior walls forming cavity 45. In addition, the ribs 46 retain the glue 47 in place to provide a uniform bond. Ridges of glue 47 are formed between the ribs 46 to more securely hold arrow nock 36 on the end of shaft 38. Ribs 46 can cause localized surface deformation on the tip 37 or arrow shaft 38 to further assist in securing nock 36 in place.

As shown in FIG. 8, a circumferential, rearwardly facing shoulder 38A can be provided at the interface of shaft 38 where the tapered tip 37 begins. A forward end 44A of base 44 can abut against the shoulder 38A and limit further forward movement of nock 36 onto the tip 37. A rearward pocket 45A is formed between the end of tip 37 and the innermost end of cavity 45 (see FIG. 6) where an additional amount of glue can be located to further assist in securing the nock 36 to the arrow shaft 38.

In use nock 36 can be installed on the tip 37 of arrow shaft 38 with or without glue. In sport archery, an archer commonly shoots a plurality of arrows known as a group of arrows, in sequence at a single target. Oftentimes an arrow strikes the nock of another arrow already imbedded in the target. The arriving arrow is deflected and the nock of the imbedded arrow is damaged. In use of the nock 36 installed on such an imbedded arrow without glue, the nock will break away cleanly upon impact of the tip of the arriving arrow. The nock of the imbedded arrow is readily replaced. In other applications glue 47 can be used to securely hold nock 36 in place.

Nock 36 is provided with longitudinal bowstring retaining ridges 48, 49. Ridge 48 is comprised as a raised longitudinal ridge with an arcuate cross section formed on the inner surface of nock leg 40 facing bowstring notch 41 extending from the inner end of bead 42 to the seat of notch 41. The crest of ridge 48 protrudes inwardly into the notch 41 a distance less than the bead 42 and, as shown in FIG. 6, is of a width less than the bead 42. Another ridge 49 is also comprised as a symmetrical longitudinal ridge formed on the inner surface of the leg 39 having a crest protruding into the bowstring notch 41 and extending from the inner end of the bead 43 to the seat of notch 41. The crest of second ridge 49 extends into the notch 41 a distance less than the bead 43 and ridge 49 has a width less than the bead 43. The distance between the respective crests of the ridges 48, 49 is approximately equal to the diameter of the intended bowstring 35. The ridges 48, 49 make point contact with the bowstring 35 as it is engaged in the seat of notch 41 to assist in holding it in place and prevent slippage or "walking". In manufacture of the nock 36, the distance between the crests of the ridges 48, 49 can be varied according to the diameter of the intended bowstring to be used with the nock. The ridges 48, 49 offer little resistance to the release of the bowstring 35.

A further form of arrow nock is shown in FIGS. 10 through 12 wherein an arrow nock indicated generally at 50 is installed on the conical or pointed rear tip 51 of an arrow shaft 52. Arrow nock 50 has a pair of transversely spaced apart legs 53, 54 defining a bowstring retaining notch 55. Leg 53 has a bead 56 for mating with a second bead 57 located on second leg 54 as previously described to retain the nock with respect to a bowstring.

Nock 50 has a base 58 with a thin walled forward portion defining a rearwardly tapered or conical opening or cavity 59 generally configured so that the tip 51 of arrow shaft 52 rests snugly therein. A plurality of retaining ribs 60, 61 are formed on the interior walls of base 58 defining cavity 59 and extend inward of cavity 59. Each rib 60, 61 is comprised as a helical spiral extending from the wider forward portion of cavity 59 rearward toward the narrow end portion circumscribing the interior cavity 59. As shown in FIG. 11, two helical ribs 60, 61 are intertwined. A single rib or more than two intertwined helical ribs could be provided. The ribs are in surface contact with the outer surface of the tip 51 of shaft 52. Nock 50 is installed on tip 51 of shaft 52 by exertion of a slight force and effecting a slight twist of nock 50 whereby the nock is screwed onto the tip 51. The helical ribs 60, 61 can cause local surface deformation on the tip 51 to securely hold the nock 50 thereon. The nock 50 can be installed on the tip 51 with or without glue. A binder or glue 63 can be provided on the tip 51 to serve not only the usual adhesive function, but also to form shoulders between the adjacent glue retaining ribs to securely bond nock 50 to the arrow shaft 52.

Bead 56 is generally teardrop shaped having an outer end comprised as an arcuate convex outer surface located inwardly from the outer end of leg 53. The inner end of bead 56 facing the interior of string notch 55 has an arcuate convex surface smaller than the arcuate outer surface of the outer end. The inner end of bead 56 has a major sloping ramp portion or surface 64 extended continuously from the arcuate convex outer portion, and a minor sloping ramp portion or surface 65 extended from the major sloping portion 64 toward the seat of string notch 55. The slope of the major sloping portion 64 can be approximately 9 degrees with respect to a longitudinal nock axis and the slope of the minor sloping portion 65 can be approximately 4 degrees. In like fashion, second bead 57 has a generally teardrop shape having an outer end comprised as an arcuate convex outer surface located inwardly from the outer end of leg 54. Bead 55 is shaped as a mirror image of the first bead 56 and has a major sloping portion 67 extended from the major sloping portion 66. The two minor sloping portions 65, 67 serve to inhibit unwanted movement of a bowstring 68 located in the seat of notch 55 in addition to providing a smooth transition channel to the throat formed between the crests of the beads 56, 57.

While there has been shown and described certain preferred embodiments of arrow nocks according to the present invention, it will be apparent to those skilled in the art that deviation and variation from the embodiments shown can be had without departing from the scope and spirit of the invention.

The embodiments of the invention in which an exclusive property or privilege is claimed are defined as follows:

1. An arrow nock comprising:

a base securable to an end of an arrow shaft;

first and second legs rearwardly extended from the base and transversely spaced apart having interior surfaces defining a bowstring notch inwardly terminated at a bowstring seat at the conjunction of the legs;

first and second curved bead means centrally located on the interior surfaces of the first and second legs having spaced apart crests projected into said notch in facing relationship to one another forming a bowstring restraining throat having a transverse dimension less than the transverse dimension of the notch proximate the seat, each bead means having a generally teardrop shape, an inner end having an arcuate outer surface and an outer end having an arcuate outer surface.

2. The arrow nock of claim 1 wherein:

each bead means has an elongate gradually sloping ramp surface orientated toward the seat of the notch.

3. The arrow nock of claim 2 wherein:

the width of each bead means is less than the width of the respective leg upon which it is situated.

4. The arrow nock of claim 3 wherein:

the base and legs and bead means are molded of plastic.

5. The arrow nock of claim 1 wherein:

the bowstring seat has a convex curve.

6. The arrow nock of claim 1 wherein:

the width of each bead means is less than the width of the respective leg upon which the bead means is attached.

7. The arrow nock of claim 1 wherein:

the arcuate surface of the inner end of the bead means is smaller than the arcuate outer surface of the outer end of the bead means.

8. The arrow nock of claim 1 wherein:

each bead means has a sloping ramp surface orientated toward the seat of the notch, said sloping ramp surface having a major ramp portion extended inward towards the seat of the notch from the crest of the bead means and a minor ramp portion extended inwardly towards the seat of the notch from the major ramp portion, said major ramp portion having an inclination greater than the minor ramp portion relative to a longitudinal nock axis.

9. The arrow nock of claim 8 wherein:

said major ramp portions are orientated at an inclination of 9 degrees relative to a longitudinal axis of the arrow nock, and said minor ramp portions are inclined at an angle of approximately 4 degrees relative to a longitudinal axis of the arrow nock.

10. The arrow nock of claim 8 wherein:

said base has walls defining a forwardly open cavity shaped for receipt of a portion of the rearward end of an arrow shaft; and retaining rib means located on said walls defining said cavity for retaining said arrow nock on the rearward end of an arrow shaft.

11. The arrow nock of claim 10 wherein:

said rib means comprises a plurality of concentric spaced apart ribs formed on said side wall defining said cavity and extending inward of said cavity.

12. The arrow nock of claim 10 wherein:

said cavity is generally conical in shape for fitting an arrow shaft having a generally conical shape rearward tip, said rib means comprising at least one helical spiral rib formed on said wall defining said cavity and extending inward thereof.

13. The arrow nock of claim 12 including:

a second helical shaped rib formed on said wall defining said cavity and intertwined with said first rib.

14. The arrow nock of claim 13 wherein:

the width of each bead means is less than the width of the respective leg upon which it is situated.

15. The arrow nock of claim 1, 2 or 3 including:

a first longitudinal ridge located on the interior surface of the first leg extended from the first bead means to the notch seat; a second longitudinal ridge located on the interior surface of the second leg extended from the second bead means to the notch seat.

16. The arrow nock of claim 15 wherein:

the ridges are narrower than the bead means and have crests protruding into the notch spaced apart a distance greater than the crests of the bead means.

17. The arrow nock of claim 16 wherein:

said base has walls defining a forwardly open cavity shaped for receipt of a portion of the rearward end of an arrow shaft; and retaining rib means located on said walls defining said cavity for retaining the base with respect to the end of the arrow shaft.

18. The arrow nock of claim 17 wherein:

said rib means comprises a plurality of concentric spaced apart ribs formed on said side wall defining said cavity and extending inward of said cavity.

19. The arrow nock of claim 17 wherein:

said cavity is generally conical in shape for fitting an arrow shaft having a generally conical shaped rearward tip, and said rib means comprises at least one helical spiral rib formed on said wall defining said cavity and extending inward thereof.

20. The arrow nock of claim 19 including:

a second helical spiral rib formed on said wall defining said cavity and intertwined with said first rib.

21. An arrow nock comprising:

a base securable to an end of an arrow shaft;

first and second legs rearwardly extended from the base and transversely spaced apart having interior surfaces to define a bowstring notch inwardly terminated at a bowstring seat at the conjunction of the legs;

first and second curved bead means centrally located on the interior surfaces of the first and second legs having spaced apart crests projected into said notch in facing relationship to one another forming a bowstring restraining throat having a transverse dimension less than the transverse dimension of the notch proximate the seat;

a first longitudinal ridge located on the interior surface of the first leg extended from the first bead means to the notch seat;

a second longitudinal ridge located on the interior surface of the second leg extended from the second bead means to the notch seat.

22. The arrow nock of claim 21 wherein:

each bead means is generally teardrop shaped with an elongate gradually sloping ramp surface orientated toward the seat of the notch.

23. The arrow nock of claim 22 wherein:

the width of each bead means is less than the width of the respective leg upon which it is situated.

24. The arrow nock of claim 21 wherein:

said base has walls defining a forwardly open cavity shaped for receipt of a portion of the rearward end of an arrow shaft;

retaining rib means located on said walls defining said cavity for retaining glue therein with respect to said walls defining the cavity and the portion of the rearward end of the arrow shaft locatable in the cavity;

said cavity being generally conical in shape for fitting an arrow having a generally conical shaped rearward tip.

25. The arrow nock of claim 24 wherein:

said rib means comprises a plurality of concentric spaced apart ribs formed on said side wall defining said cavity and extending inward of said cavity.

26. The arrow nock of claim 24 wherein:

said rib means comprises at least one helical spiral rib formed on said wall defining said cavity and extending inward thereof.

27. The arrow nock of claim 26 wherein:

each bead means is generally teardrop shaped with an elongate gradually sloping ramp surface orientated toward the seat of the notch.

28. The arrow nock of claim 27 wherein:

the width of each bead means is less than the width of the respective leg upon which it is situated.

29. The arrow nock of claim 26 including:

a second helical shaped rib formed on said wall defining said cavity and intertwined with said first rib.

30. The arrow nock of claim 26 including:

a plurality of said helical shaped ribs intertwined with one another formed on said wall defining said cavity.

31. The arrow nock of claim 21 including:

a first longitudinal ridge located on the interior surface of the first leg extended from the first bead means to the notch seat; a second longitudinal ridge located on the interior surface of the second leg extended from the second bead means to the notch seat.

32. The arrow nock of claim 21 wherein:

each bead means is generally teardrop shaped with a sloping ramp surface orientated toward the seat of the notch, said sloping ramp surface having a major ramp portion extended inward towards the seat of the notch from the crest of the bead means and a minor ramp portion extended inwardly towards the seat of the notch from the major ramp portion, said major ramp portion having an inclination greater than the minor ramp portion relative to a longitudinal nock axis.

33. An arrow for use with a bow equipped with a bowstring comprising:

an elongated shaft having a forward end and a rear end;

an arrowhead mounted on the forward end of the shaft, and a nock mounted on the rear end of the shaft, said nock having a base secured to said rear end of the shaft;

a plurality of legs attached to the base and projected rearwardly from the base, said legs including first and second transversely spaced legs having facing interior surfaces joined to a bottom surface of the base defining a groove for accommodating the bowstring;

each of said interior surfaces including convex curved bead means providing the groove with a throat between said surfaces, each of said bead means having a crest forming the narrowest width of the throat, said width being smaller than the diameter of the bowstring whereby the nock holds the arrow on the bowstring, each bead means having a generally teardrop shape and an elongated generally sloping ramp surface orientated toward the bottom surface of the base and having an inner end having an arcuate outer surface and an outer end having an arcuate outer surface.

34. The arrow of claim 33 wherein:

said base has a recess accommodating the end of the shaft.

35. The arrow of claim 33 wherein:

the bottom surface of the base is a bowstring seat having a convex curve.

36. The arrow of claim 33 wherein:

the width of each bead means is less than the width of the leg carrying the bead means.

37. The arrow of claim 33 wherein:

the arcuate outer surface of the inner end of the bead means is smaller than the arcuate outer surface of the outer end of the bead means.

38. An arrow nock comprising:

a base securable to an end of an arrow shaft;

first and second legs rearwardly extended from the base and transversely spaced apart having interior surfaces defining a bowstring notch inwardly terminated at a bowstring seat at the conjunction of the legs;

first and second curved bead means centrally located on the interior surfaces of the first and second legs having spaced apart crests projected into said notch in facing relationship to one another forming a bowstring restraining throat having a transverse dimension less than the transverse dimension of the notch proximate the seat, each bead means being generally teardrop shaped with a sloping ramp surface orientated toward the seat of the notch, said sloping ramp surface having a major ramp portion extended inward towards the seat of the notch from the crest of the bead means and a minor ramp portion extended inwardly towards the seat of the notch from the major ramp portion, said major ramp portion having an inclination greater than the minor ramp portion relative to a longitudinal nock axis, said major ramp portions being orientated at an inclination of 9 degrees relative to a longitudinal axis of the arrow nock, and said minor ramp portions being inclined at an angle of approximately 4 degrees relative to a longitudinal axis of the arrow nock.

* * * * *